US005233267A

United States Patent [19]

Tominaga et al.

[11] Patent Number: 5,233,267

[45] Date of Patent: Aug. 3, 1993

[54] DYNAMIC CONVERGENCE SYSTEM FOR COLOR CATHODE RAY TUBES HAVING AN IN LINE ELECTRON GUN

[75] Inventors: Noboru Tominaga, Takatsuki; Katsuyo Iwasaki, Nishinomiya; Koichi Sugahara, Sakai; Toshio Kuramoto, Takatsuki; Kenji Uozumi, Jyoyo, all of Japan

[73] Assignee: Matsushita Electronics Corporation, Osaka, Japan

[21] Appl. No.: 908,839

[22] Filed: Jul. 2, 1992

Related U.S. Application Data

[63] Continuation of Ser. No. 588,647, Sep. 26, 1990, abandoned.

[30] Foreign Application Priority Data

Oct. 3, 1989 [JP] Japan ..... 1-259242

[51] Int. Cl.[5] ..... H01J 29/56; H01J 29/51

[52] U.S. Cl. ..... 313/412; 313/413; 313/414; 313/428; 313/431; 313/437; 335/213

[58] Field of Search ..... 313/412, 413, 414, 431, 313/437, 428, 421; 335/213, 296, 297, 299

[56] References Cited

U.S. PATENT DOCUMENTS 2,157,182 5/1939 Maloff ..... 313/431
3,594,600 7/1971 Murata et al. ..... 313/79
3,946,266 3/1976 Saito et al. ..... 313/413 X
4,625,144 11/1986 Kornaker ..... 313/412
4,642,527 2/1987 Takahashi et al. ..... 313/412 X
4,961,021 10/1990 Ogura et al. ..... 313/412

FOREIGN PATENT DOCUMENTS 0218961 4/1987 European Pat. Off. .
64-62993 3/1989 Japan .
2097995 11/1982 United Kingdom ..... 313/412
2202082 9/1988 United Kingdom .

*Primary Examiner*—Donald J. Yusko
*Assistant Examiner*—Ashok Patel
*Attorney, Agent, or Firm*—Panitch Schwarze Jacobs & Nadel

[57] ABSTRACT

A color cathode ray tube equipped with an in-line type electron gun, a deflection yoke designed to generate a uniform deflection magnetic field, the in-line type electron gun having a focusing grid which accommodates three pole pieces of magnetic bodies, and a magnetic field generator disposed outside the cathode ray tube so as to apply 4-pole dynamic magnetic fields to the pole pieces, thus constituting a dynamic convergence system capable of correcting any misconvergence of the three electron beams in a vertical direction or a horizontal direction.

5 Claims, 3 Drawing Sheets

DYNAMIC CONVERGENCE SYSTEM FOR COLOR CATHODE RAY TUBES HAVING AN IN LINE ELECTRON GUN

This application is a continuation of U.S. application Ser. No. 07/588,647, filed Sept. 26, 1990, now abandoned.

BACKGROUND OF THE INVENTION

1. Field of the Invention

The present invention relates generally to a color cathode ray tube, and more particularly to a color cathode ray tube equipped with an in-line type electron gun and a deflection yoke which is designed to generate a uniform deflection magnetic field, thus constituting a dynamic convergence system capable of correcting a misconvergence of three electron beams in a vertical direction or a horizontal direction.

2. Description of the Prior Art

In general, a deflection yoke used in color cathode ray tubes equipped with an in-line type electron gun produces a pin-cushion shape horizontal deflection magnetic field and a barrel-shaped vertical deflection magnetic field. This type of deflection yoke is advantageous in eliminating the necessity of correcting deflections by use of a dynamic convergence system, thereby requiring no complex convergence circuit. However, the non-uniform deflection magnetic field is likely to distort the beam spots owing to deflection, thereby failing to achieve high resolution particularly in a peripheral area of a picture image.

It is known that a cathode ray tube equipped with a delta type electron gun is provided with a deflection yoke capable of generating a uniform magnetic field. To overcome the problem pointed out above, the same method is applied to a color cathode ray tube equipped with an in-line type electron gun should be provided with such a deflection yoke so as to constitute a dynamic convergence system capable of correcting a misconvergence of three electron beams.

Referring to FIG. 5, Japanese Laid-Open Patent Publication No. 64-62993 discloses a color cathode ray tube having a convergence unit 1 provided at the head of an anode which acts as a final accelerating grid, and a pair of mutually opposing magnetic field generators 2 and 3 mounted on the periphery of a neck portion 4 of the cathode ray tube. The convergence unit 1 includes two pairs of magnetic pole pieces 7*a*, 7*b* and 8*a*, 8*b* in a cup-shaped housing of non-magnetic metal. The pole pieces 7*a*, 7*b* and 8*a*, 8*b* are disposed with electron beam paths 5 and 6 being interposed between each pair. In addition, a center beam path 9 is disposed between a pair of shield plates 9*a* and 9*b*. The magnetic field generators 2 and 3 include U-shaped cores 2*a* and 3*a* around which coils 2*b* and 3*b* are wound, and are supported so that their leg portions are magnetically connected to the outsides of the pole pieces 7*a*, 7*b*, and 8*a*, 8*b*, respectively.

The dynamic convergence correction is effected by passing a parabolic current or any other sawtooth-shaped waveform dynamic current through the coils 2*b* and 3*b*, wherein the dynamic current increases proportionally as the degree of beam deflection becomes large. The electron beams are deflected in the opposite direction, as indicated by the large arrows 1O*a* and 10*b*, owing to the two-pole magnetic fields generated from the legs of the cores 2*a* and 3*a* to the pole pieces 7*a*, 7*b* and 8*a*, 8*b*.

An advantage of the dynamic convergence correction is that the corrected magnetic field is intensified by the two pairs of pole pieces, thereby ensuring an optimum convergence correction with high sensitivity. The disadvantage is that the dynamic convergence correction is only effected in a horizontal direction and cannot be effected in a vertical and a horizontal direction at the same time.

SUMMARY OF THE INVENTION

The color cathode ray tube of the present invention, which overcomes the above-discussed and numerous other disadvantages and deficiencies of the prior art, comprises an in-line type electron gun, a deflection yoke capable of generating a uniform magnetic field so as to correct a misconvergence of three electron beams by the dynamic convergence system, wherein the in-line type electron gun comprises a focusing grid with an oval hollow body having a horizontal major axis and a vertical minor axis, the focusing grid accommodating three pole pieces, the first of which is a rectangular shaped body made of a magnetic material that is centered inside the oval hollow body so as to enclose a central electron beam path, the second and third pole piece being situated to the left and right but separated from the first pole piece to provide a second side beam path and a third side beam path therebetween, the second and third pole piece each having an inside surface flat and parallel to the first pole piece, and an outside surface curved similar to the curved side of the oval hollow body of the focusing grid, a magnetic field generator disposed around the neck portion of the cathode ray tube, the magnetic field generator comprising a ring-shaped core having four poles each having coils, the ring-shaped core surrounding the neck portion having two poles diametrically situated opposed to the top and bottom sides of the first pole piece and the other diametrically situated two poles being opposed to the sides of the second and third pole piece so that a dynamic current can be made to flow through the coils.

In a preferred embodiment, the second pole piece and the third pole piece have a dome-shaped hollow body with a domed roof portion and a flat bottom portion.

In a preferred embodiment, the second pole piece and the third pole piece are disposed with their flat bottom portions being parallel to the respective sides of the first rectangular pole piece.

Thus, the invention described herein makes possible the objectives of (1) providing a color cathode ray tube capable of effecting vertical dynamic convergence correction without negating the capability of effecting horizontal dynamic convergence correction by means of the conventional convergence unit, and (2) providing a color cathode ray tube capable of achieving high resolution over picture images throughout the screen without the necessity of prolonging the length of an electron gun.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

The present invention will now be described with reference to the drawings, and initially with respect to FIG. 1 and reference axes (X,Y,Z) which represent, respectively, a horizontal axis, a vertical axis, and a center axis.

Figure 1:
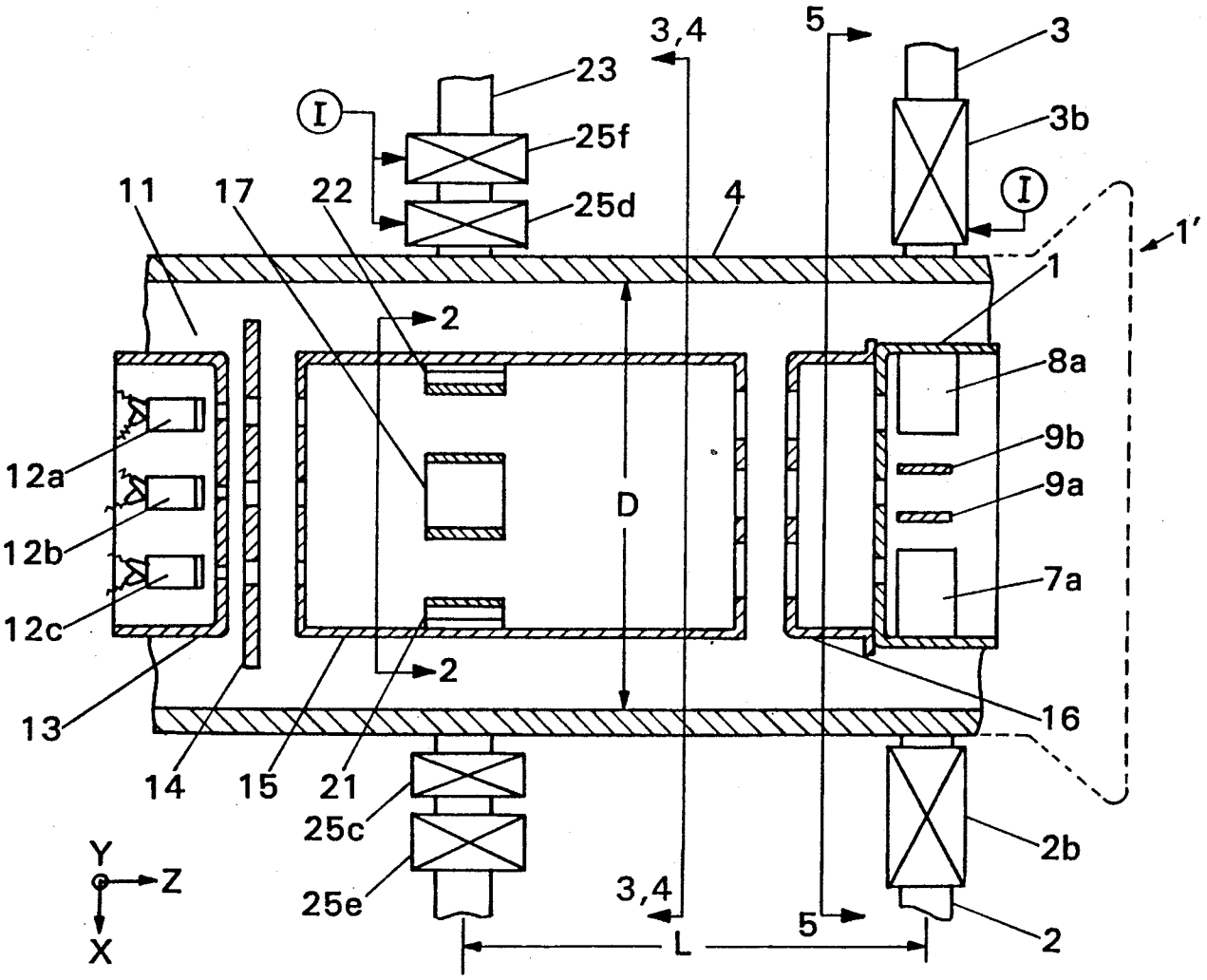
FIG. 1 is a vertical side view showing a main portion of a color cathode ray tube according to the present invention.
Figure 5:
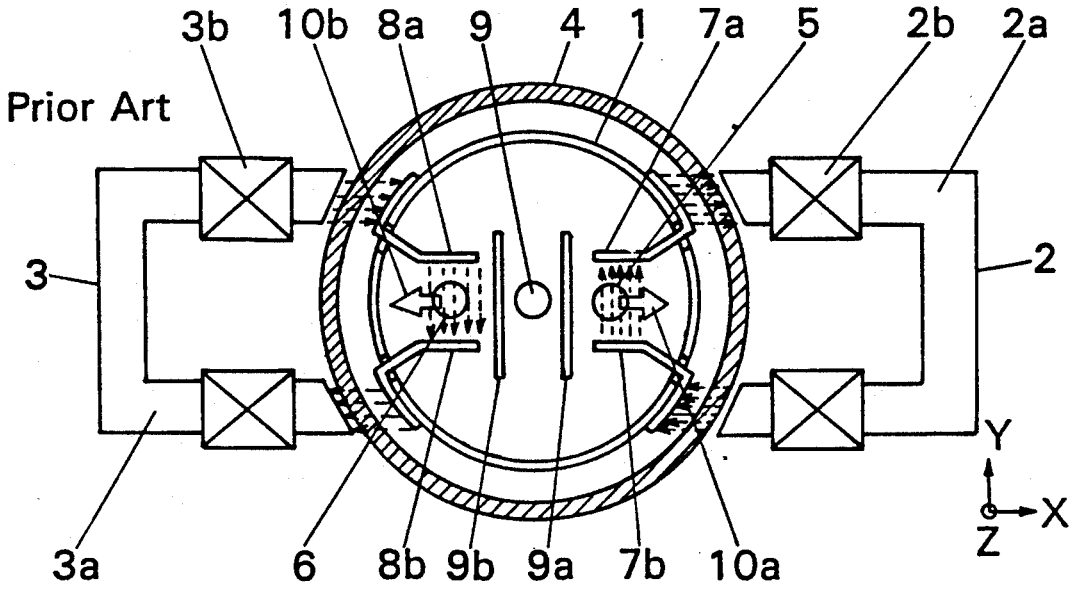
FIG. 5 is a schematic view showing a magnetic field appearing in the horizontal cross-section of a known color cathode ray tube.

Referring to FIG. 1, a color cathode ray tube 1' made of glass accommodates an in-line type electron gun 11 in its neck portion 4 (along the Z axis). The electron gun 11 includes three cathodes 12*a*, 12*b*, and 12*c*, a control grid 13, an accelerating grid 14, a focusing grid 15, and an anode 16 acting as a final accelerating grid. The focusing grid 15 and the anode 16 have cylindrical bodies of metal whose horizontal axis (X axis) is larger than its vertical axis (Y axis). The anode 16 is provided with a convergence unit 1 at the head thereof, the convergence unit 1 having the same structure as that shown in FIG. 5. More specifically, the convergence unit 1 has two pairs of pole pieces 7*a*, 7*b*, and 8*a*, 8*b*. Two pairs of two-pole magnetic field generators 2 and 3 are mounted around a periphery of the neck portion 4 at opposite positions, so that they are magnetically connected to the pole pieces 7*a*, 7*b*, and 8*a*, 8*b* of U-shaped cores 2 and 3 having leg portions around which coils 2*a* and 2*b* are wound.

Figure 2:
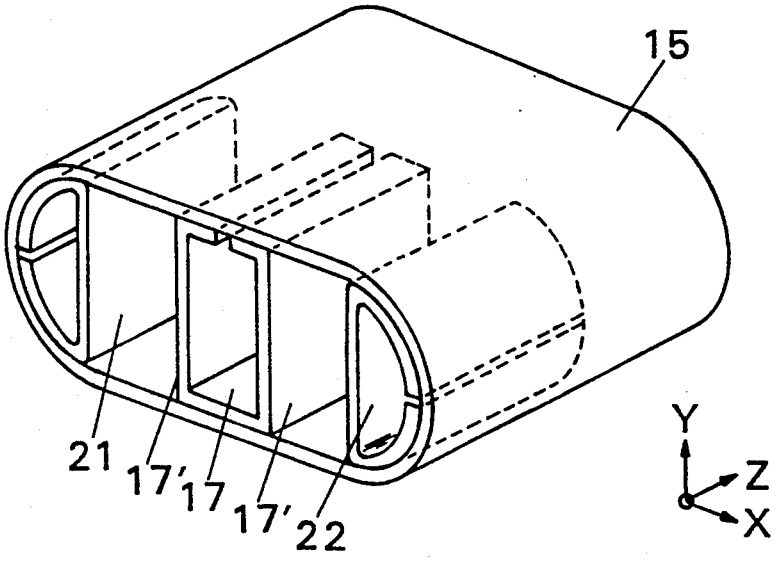
FIG. 2 is a perspective view showing a relationship among a focusing grid, and a first, a second and a third magnetic pole.
Figure 3:
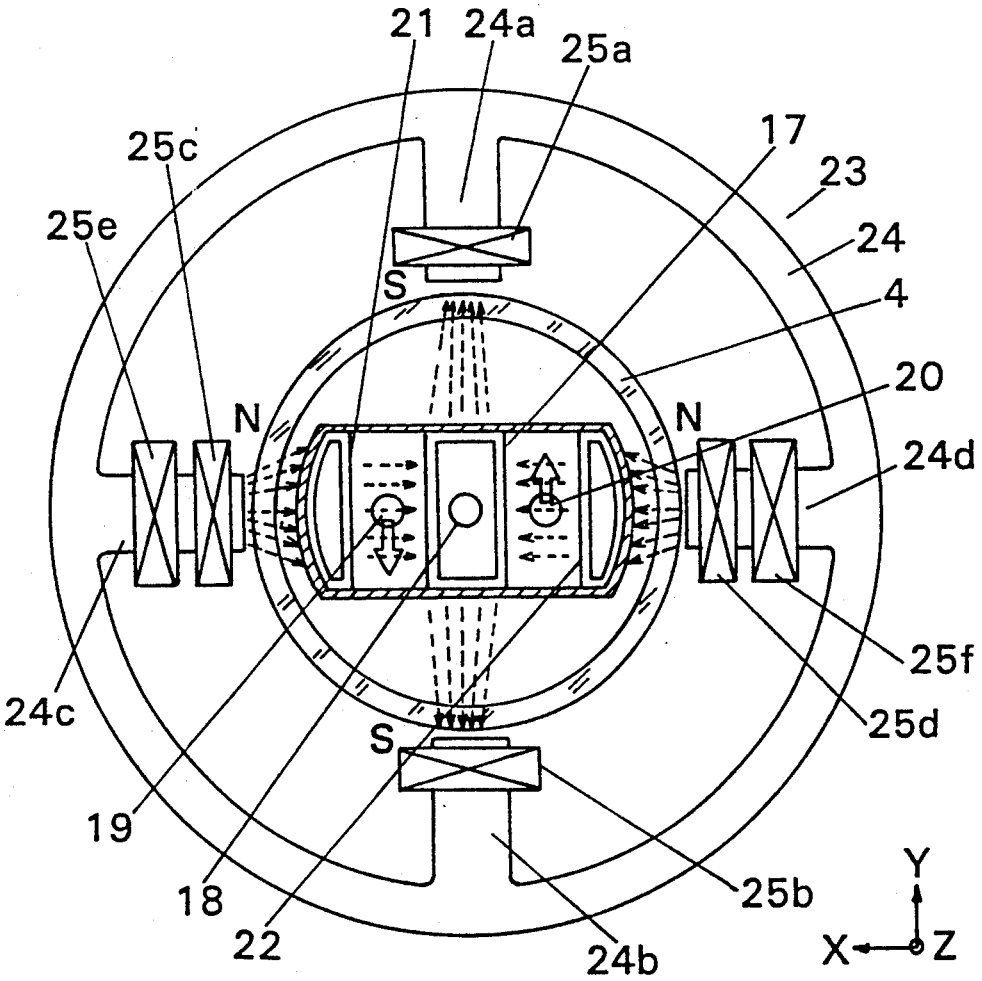
FIGS. 3 and 4 are schematic views showing a magnetic field appearing in the horizontal cross-section of the cathode ray tube of the invention.
Figure 4:
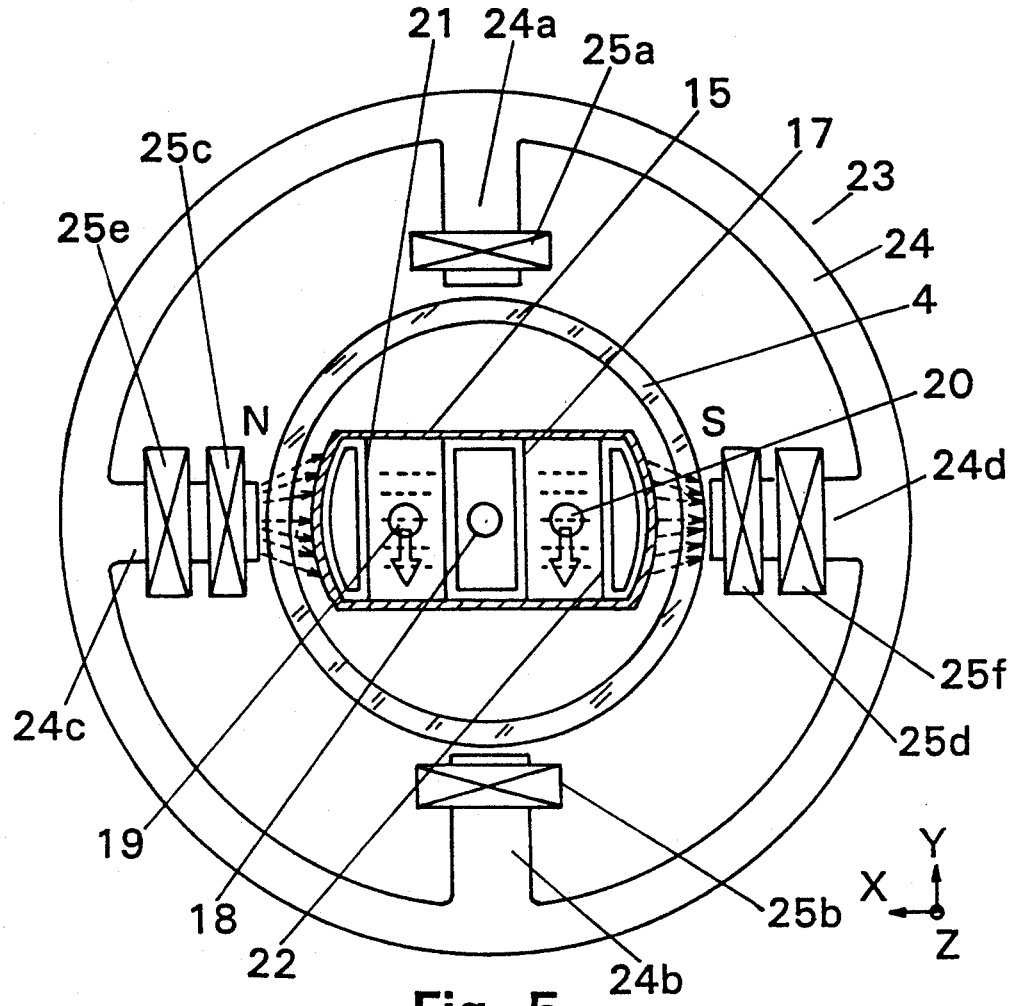

As shown in FIGS. 2 and 3, the focusing grid 15 of non-magnetic metal has a hollow main body having an oval cross-section having a horizontal major axis and a vertical minor axis, accommodating three pole pieces 17, 21, and 22 therein. The first pole piece 17 is a rectangular ,shaped body of a magnetic material having vertical portions 17' that is centered inside the main body in such a manner as to enclose an electron beam path 18. The second and third pole pieces 21 and 22 are situated on opposite sides of the first pole piece 17. Each pole piece 21 and 22 is dome-shaped with a curved portion that generally follows the curvature of the adjacent portion of the focusing grid 15, and a flat portion which is positioned parallel to the vertical portions 17'. As shown in FIG. 3, the electron beam side paths 19 and 20 are disposed between the first and second pole pieces 17 and 21, and between the first and third pole pieces 17 and 22.

As shown in FIG. 3, a magnetic field generator 23 is disposed around the periphery of the neck portion 4. The magnetic field generator 23 includes a ring-shaped 4-pole core 24 of ferrite having magnetic poles 24*a*, 24*b*, 24*c*, and 24*d*, each of which has a coil 25*a*, 25*b*, 25*c*, and 25*d*. In addition, the poles 24*c* and 24*d* have other coil 25*e* and 25*f*. The poles 24*a* and 24*b* are magnetically connected to the top and bottom sides of the first pole piece 17, and the poles 24*c* and 24*d* are magnetically connected to the outsides of the flat portions of the pole pieces 21 and 22, respectively. In FIG. 1, the distance L between the centers of the magnetic field generators 2 (3) and 23 is predetermined to be 0.5 times or more the inside diameter D of the neck portion 4 so as to be out of reach of the magnetic field of each generator 2, 3, and 23.

Under the arrangement described above, when a 4-pole correction is to be effected, a dynamic current I is flown through the coils 25*a* to 25*d* so that the poles 24*a* and 24*b* become positive and the poles 24*c* and 24*d* become negative, thereby effecting dynamic convergence. As a result, within the focusing grid 15 a magnetic field is generated as indicated by the dotted lines in FIG. 3, and the electron beams at each side are vertically urged in opposite directions as indicated by the large arrows. The electron beams at the center are shielded from the magnetic field by the pole piece 17.

When a two-pole correction is to be effected, a dynamic current is allowed to flow through the coils 25*e* and 25*f* so that either pole 24*c* or 24*d* becomes negative and the other becomes positive, so as to generate a magnetic field in the focusing grid 15. As a result, the electron beams at each side are urged upwards or downwards as indicated by the large arrows.

As is evident from the foregoing, the present invention makes it possible to effect vertical dynamic convergence correction without negating the capability of effecting horizontal dynamic convergence correction by means of the conventional convergence unit. In addition, high resolution is achieved over picture images throughout the screen without the necessity of prolonging the length of an electron gun.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A color cathode ray tube comprising an in-line electron gun disposed within a neck portion thereof for generating three electron beams, wherein the in-line electron gun comprises:

a focusing grid with an oval hollow body having a horizontal major axis and a vertical minor axis, the oval hollow body enclosing three pole pieces, a first of which is a rectangular shaped hollow body made of a magnetic material that is centered inside the oval hollow body to pass a central electron beam path, a second pole piece and a third pole piece being situated to the left and right but separated from the first pole piece to provide a second side beam path and a third side beam path therebetween, the second and third pole pieces each having a flat portion parallel to respective vertical sides of the first pole piece, and a curved portion curved with respect to a respective curved side of the oval hollow body of the focusing grid, a magnetic field generator disposed around the neck portion surrounding the first, second and third pole pieces, the magnetic field generator comprising a ring-shaped core having four poles each having at least one coil, two of the four poles diametrically situated opposed to top and bottom horizontal sides of the first pole piece and the remaining two poles diametrically situated opposed to the curved portions of the second and third pole piece so that a dynamic current can be made to flow through the coils, an anode parallel to and located beyond said focusing grid, and whereby said electron beams which pass through said focusing grid to said anode along said second and third side beam paths are deflected vertically relative to said minor axis as a function of said dynamic current.

2. A color cathode ray tube apparatus, comprising:

an in-line electron gun disposed within a neck portion of said cathode ray tube apparatus, said electron gun having a central cathode, two side cathodes, an anode, and a focusing grid;

said focusing grid including a central first pole piece, a second pole piece positioned lateral to and spaced from said first pole piece, and a third pole piece positioned laterally symmetrically opposite to said second pole piece;

said cathodes, said focusing grid and said anode disposed so that a central beam path from said central cathode passes through said first pole piece of said focusing grid and said anode in an axial direction of said color cathode ray tube apparatus, and each of two side beam paths from said side cathodes pass through respective ones of said second pole piece and said third pole piece of said focusing grid and said anode in the axial direction of said color cathode ray tube apparatus;

first magnetic field generation means disposed externally around said neck portion surrounding said focusing grid and said first, second and third pole pieces, and said first magnetic field generation means having four magnetic poles, a first magnetic pole, a second magnetic pole, a third magnetic pole and a fourth magnetic pole, each of said magnetic poles having at least one coil;

said first magnetic pole disposed adjacent to a first side of said central first pole piece, said second magnetic pole disposed symmetrically opposite to said first magnetic pole and adjacent to a second side of said central first pole piece, to magnetically connect said first and second sides of said central first pole piece with said adjacent magnetic poles, respectively, said third magnetic pole disposed adjacent to a side of said second pole piece to magnetically connect said side of said second pole piece with said third magnetic pole, said fourth magnetic pole disposed adjacent to a side of said third pole piece to magnetically connect said side of said third pole piece with said fourth magnetic pole; and dynamic current means for creating a dynamic current through said at least one coil of said magnetic poles of said first magnetic field generation means to effect deflection of said two side beam paths as a function of said dynamic current.

3. A color cathode ray tube apparatus according to claim 2, wherein said second pole piece and said third pole piece of said focusing grid each has a hollow body with a cross-sectional shape having a flat side and arcuate side.

4. A color cathode ray tube apparatus according to claim 2, said color cathode ray tube apparatus further comprising:

a convergence unit disposed adjacent said anode, said convergence unit having two pairs of pole pieces;

second magnetic field generation means disposed externally around said convergence unit, said second magnetic field generation means having two pairs of secondary magnetic poles, each pair of said secondary magnetic poles of said second magnetic field generation means corresponding to a respective pair of said pairs of pole pieces, each of said secondary magnetic poles being disposed symmetrically laterally adjacent to a side of a corresponding one of said pole pieces to magnetically connect said side of said pole piece with said adjacent secondary magnetic pole, each of said secondary magnetic poles having at least one coil; and a second dynamic current means for creating a second dynamic current through said at least one coil of said secondary magnetic poles of said second magnetic field generation means to effect deflection of said two side beam paths as a function of said second dynamic current in a direction substantially perpendicular to said deflection effected by said first magnetic field generation means.

5. A color cathode ray tube apparatus according to claim 4, wherein a distance between said first magnetic field generation means disposed externally around said neck portion and said second magnetic field generation means disposed externally around said convergence unit is predetermined to be at least 0.5 times an inner diameter of said neck portion of said color cathode ray tube apparatus.

* * * * *